US006024360A

United States Patent [19]

Orbach et al.

[11] Patent Number: 6,024,360

[45] **Date of Patent: *Feb. 15, 2000**

[54] CURVED GEOMETRY GAME APPARATUS

[75] Inventors: Haim Orbach, POB 195, Herzlia; Moshe Klein, Kiryat Tivon, both of Israel

[73] Assignee: Haim Orbach, Herzliya, Israel

[ * ] Notice: This patent is subject to a terminal disclaimer.

[21] Appl. No.: 08/289,521

[22] Filed: Aug. 12, 1994

[51] Int. Cl.[7] ..... A63F 9/10

[52] U.S. Cl. ..... 273/157 R

[58] Field of Search ..... 273/157 R, 160, 273/155, 153 R; 434/172, 214

[56] References Cited

U.S. PATENT DOCUMENTS

| | | | |
|---|---|---|---|
| D. 96,215 | 7/1935 | Bambaci | 273/157 R |
| 2,443,468 | 6/1948 | Madden | 273/157 R |
| 3,540,732 | 11/1970 | Wilson | 273/157 R |
| 3,790,175 | 2/1974 | Ragnow | 273/160 |
| 4,243,224 | 1/1981 | Spector | 273/157 R |
| 4,629,431 | 12/1986 | Sanders | 273/157 R |
| 4,776,802 | 10/1988 | Rind et al. | 273/157 R |
| 4,830,376 | 5/1989 | Hillis | 273/157 R |
| 4,948,146 | 8/1990 | Snyder et al. | 273/157 R |
| 5,601,470 | 2/1997 | Yao | 273/157 R |

FOREIGN PATENT DOCUMENTS

| | | | |
|---|---|---|---|
| 16682 | 10/1894 | United Kingdom | 273/157 R |
| 2184027 | 6/1987 | United Kingdom | 273/157 R |

*Primary Examiner*—Steven B. Wong
*Attorney, Agent, or Firm*—Edward Langer

[57] ABSTRACT

A puzzle and game apparatus constructed of elements forming a geometrical pattern, the shape of each element providing information about its placement in the overall puzzle. In the preferred embodiment, the curved geometry game apparatus is fabricated as a plurality of elements of soft, resilient pieces of foam rubber, which are curve-shaped each with an interlocking tab and a recess formed on either of its ends. Multiple curve-shaped elements are interlockable by insertion of the tab of one element into the recess of another one. In this fashion, rings of similarly curved elements can be formed, and these rings can be placed one within another to form an overall circular shape. When the circular shape containing all the rings is disassembled, the individual elements do not immediately appear to fall into any order for reconstructing the overall shape, and further, the curve-shaped elements may have different arc lengths, which increases the difficulty of identifying them as being part of the same group. Within a group of elements forming an individual ring, the elements bear similarity one to another at least in their arc curvatures, allowing the user to reconstruct the circular shape once the elements of individual rings have been identified. The inventive game forces the user to develop an analytical solution to the problem of reconstructing the overall circular shape, and this in turn develops the user's ability to simultaneously think analytically and artistically, in accordance with modern cognitive theories of "whole brain" thinking requiring use of both brain hemispheres for their respective contributions to problem solving.

13 Claims, 2 Drawing Sheets

CURVED GEOMETRY GAME APPARATUS

The present invention relates to educational materials in the form of puzzles, games and toys which are designed for amusement together with the goal of instruction, and more particularly, to an educational game designed to teach the user about geometric relationships between ring shapes and structures.

BACKGROUND OF THE INVENTION

There is an increasing need for educational materials which are adapted to the modern theories of cognition and creativity, including "whole brain" approaches which account for left and right brain contributions to creativity, to develop skills including pattern recognition and familiarity with geometric shapes and their interrelationships.

Existing jigsaw puzzle designs and games are reconstructed typically by reference to a picture or overall pattern, portions of which appear on individual puzzle pieces. While these designs challenge the visual perception by requiring recognition of various interlocking shapes in relation to the reference picture, the shapes of the individual pieces themselves do not immediately convey any information with regard to their placement in the overall puzzle.

Therefore, it would be desirable to provide a puzzle design constructed of elements shaped to stimulate cognitive development and creative thinking, with the element shapes providing information about their placement in the overall puzzle.

SUMMARY OF THE INVENTION

Accordingly, it is a principal object of the present invention to provide a novel puzzle and game apparatus which is constructed of elements forming a geometrical pattern, the shape of each element providing information about its placement in the overall puzzle.

In accordance with a preferred embodiment of the invention, there is provided a curved geometry game apparatus comprising a plurality of planar, curve-shaped elements each formed with interlocking means at its ends for joining it to other curve-shaped elements, a group of said joined curve-shaped elements which have similar arc curvatures defining a complete circular ring, a plurality of said complete rings each placed adjacent to another at predetermined radii of a circle defining a circular shape, individual curve-shaped elements being removably insertable in said circular shape, and allowing construction of other shapes.

In the preferred embodiment, the curved geometry game apparatus is fabricated as a plurality of elements of soft, resilient pieces of foam rubber, which are curve-shaped each with an interlocking tab and a recess formed on either of its ends. Multiple curve-shaped elements are interlockable by insertion of the tab of one element into the recess of another one. In this fashion, rings of similarly curved elements can be formed, and these rings can be placed one within another to form an overall circular shape.

When the circular shape containing all the rings is disassembled, the individual elements do not immediately appear to fall into any order for reconstructing the overall shape, and further, the curve-shaped elements may have different arc lengths, which increases the difficulty of identifying them as being part of the same group. On closer inspection, it is seen that within a group of elements forming an individual ring, the elements bear similarity one to another at least in their arc curvatures, and this allows the user to reconstruct the circular shape once the elements of individual rings have been identified.

Thus, the inventive game forces the user to develop an analytical solution to the problem of reconstructing the overall circular shape, and this in turn develops the user's ability to simultaneously think analytically and artistically. In this way, the game achieves the goals presented by the modern cognitive theories of "whole brain" thinking, that of using both the right and left brain hemispheres for their respective contributions to problem solving.

Alternatively, the individual curve-shaped elements may be interlocked one with another in reverse orientation to form other shapes, such as a wave, ellipse or other curved shape.

While the game elements are designed to lie in the same plane when interlocked to form rings, it is also possible to interlock multiple elements together such that they do not lie in the same plane, and this increases the variety of shapes which may be constructed.

Other features and advantages of the invention will become apparent from the drawings and the description contained hereinbelow.

BRIEF DESCRIPTION OF THE DRAWINGS

For a better understanding of the invention, reference is made to the accompanying drawings, in which like numerals designate corresponding elements or sections throughout, and in which.

DETAILED DESCRIPTION OF A PREFERRED EMBODIMENT

Figure 1:
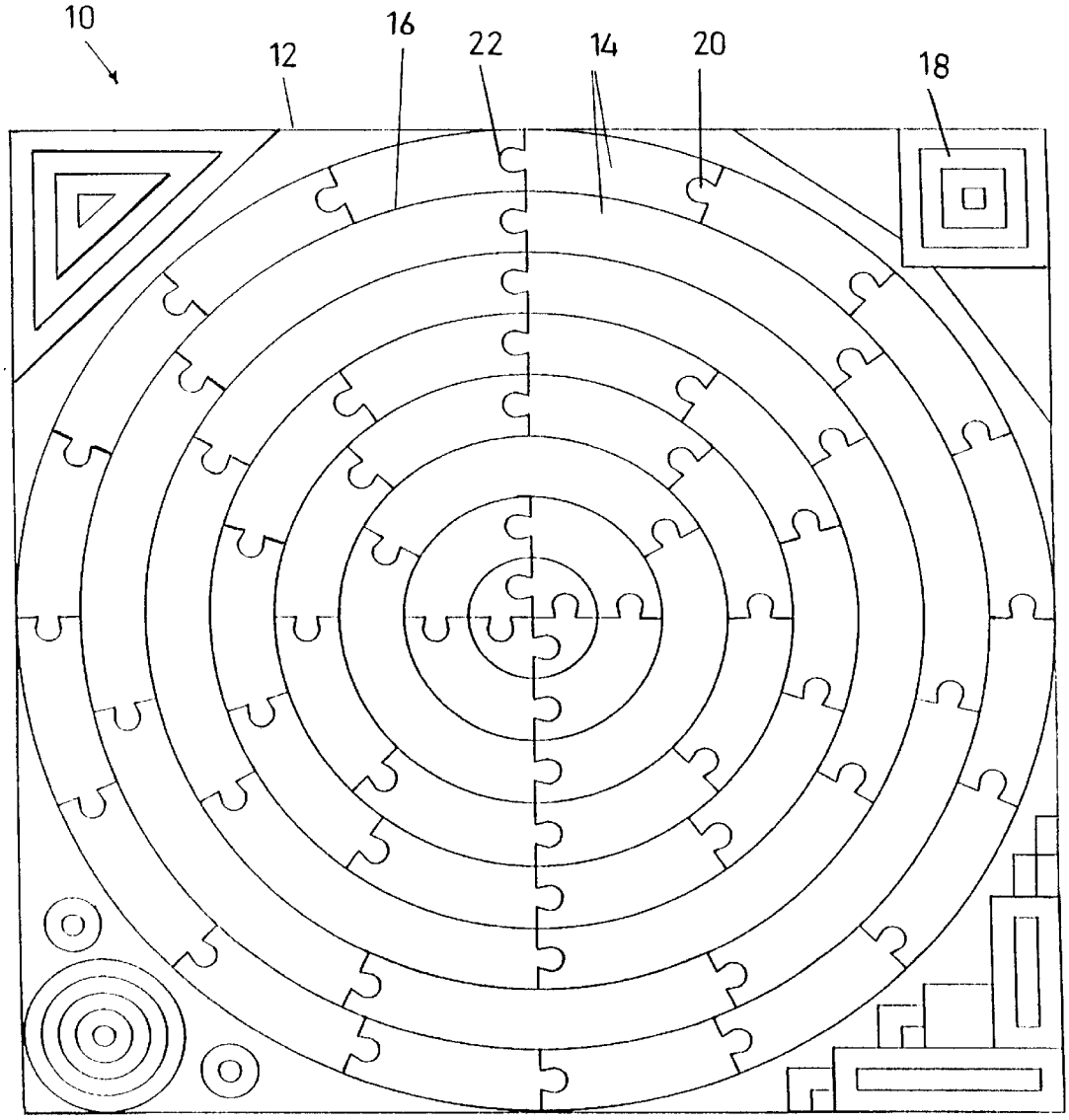
FIG. 1 is a top view of a curved geometry game apparatus constructed in accordance with the principles of the present invention.

Referring now to FIG. 1, there is shown a top view of a curved geometry game apparatus 10 constructed as a puzzle having a circular shape. Game apparatus 10 comprises a frame 12, and a plurality of curve-shaped elements 14 which are arranged as a series of rings 16 forming the circular shape. The corner areas of frame 12 have variously shaped elements 18, including rectangular and triangular shapes which are insertable within one another and once assembled, abut the inside corner areas of frame 12 as shown.

Typically, elements 14 and 18 are fabricated of resilient foam rubber, so that they are flexible, and each curve-shaped element 14 is provided with a tab 20 and recess 22 on its respective ends, which enable interlocking between individual elements. Curve-shaped elements 14 may be provided in differing arc lengths, so that for example, different rings may use a quantity of elements more or less than that of the next adjacent ring.

Figure 2:
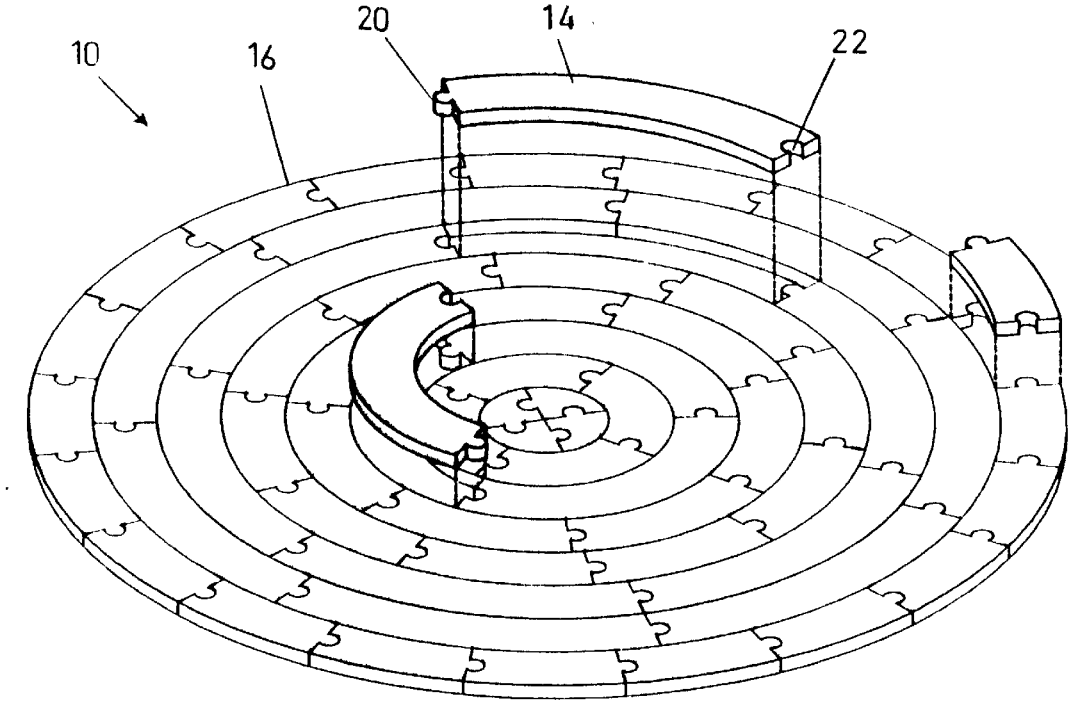
FIG. 2 is a perspective view of a circular portion of the game apparatus of FIG. 1, showing a curve-shaped element forming a portion of a ring, in removably insertable fashion.

Referring now to FIG. 2, there is shown a perspective view of the game apparatus 10, featuring interlocking curve-shaped elements 14 which are removably insertable within any of the rings 16 of the circular shape. As they are flexible, each individual one of the curve-shaped elements 14 may be pried from a ring 16, or restored to its position by applying slight pressure to depress its tab and recess 20 and 22 into the adjoining elements. If an individual element 14 is placed in its respective position and is not fully depressed therein, a stepped construction of elements 14 is created.

After all the curve-shaped elements 14 have been removed and the circular shape has been disassembled, it may be reconstructed again as a puzzle. Once disassembled, the individual curve-shaped elements 14 must be identified by their arc curvatures as falling within the group of similarly curved elements which can form a ring 16. Otherwise, the puzzle cannot be reconstructed since only the elements 14 which match the particular arc curvature of each ring 16 will enable completion of the ring, which can then fit within the circular shape.

It is a particular feature of the present invention that the reconstruction of elements 14 as a puzzle stimulates the analytical as well as the artistic capabilities of the user. Since many of the curve-shaped elements 14 look the same once disassembled, they can only be distinguished based on recognition of the different arc curvatures between them. This difference is not pronounced, therefore requiring development of visual perceptive capabilities to achieve this level of shape recognition. The information about the arc curvature helps identify the appropriate ring in which to place the element 14.

In young children, starting from approximately the age of five, the visual perceptive capabilities exist for recognition of the arc curvature differences, and thus the puzzle presents a real challenge.

Figure 3:
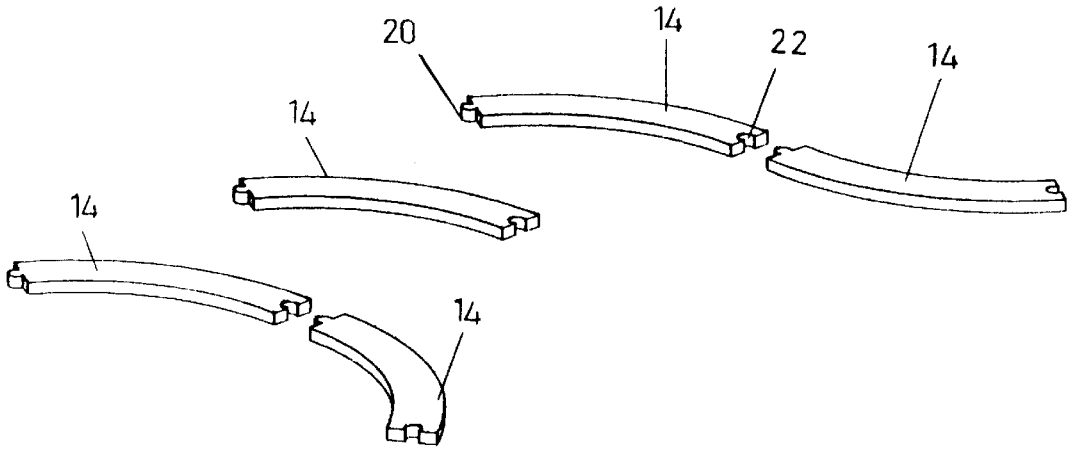
FIG. 3 shows a perspective view of several individual curve-shaped elements which are interlockable to form different shapes.

In FIG. 3, there is shown a perspective view of several individual curve-shaped elements 14 which are interlockable to form different shapes. An unlimited number of shapes may be constructed, including rings, ellipses or various wave patterns. As defined herein, a wave pattern is created where adjoining curve-shaped elements 14 are connected in reverse orientation so that the center of their curvatures do not coincide at a point.

While elements 14 are designed to lie in the same plane when interlocked to form rings 16, it is also possible to interlock multiple elements together such that they do not lie in the same plane, and this increases the variety of shapes which may be constructed.

In addition, elements 14 may be provided all of a single color on one side thereof, with another different color on the opposite side. This aids in orienting the elements for identification of the groups having similar arc curvatures. Other coloring arrangements may be provided for additional creativity.

Various versions for using the inventive game apparatus may be envisioned, based on the development of rules of play. For example, one version of the game could be a trading game between players, each of whom possesses curve-shaped elements 14 of different rings, so that a player cannot complete any one ring. In order for the circular shape to be reconstructed, players must share their supply of elements 14 with other players, in return for the elements necessary to complete their ring.

Having described the invention with regard to certain specific embodiments thereof, it is to be understood that the description is not meant as a limitation since further modifications may now become apparent to those skilled in the art and it is intended to cover such modifications as fall within the scope of the appended claims.

We claim:

1. A curved geometry game apparatus comprising a plurality of planar, curved-shaped elements some having different arc curvatures, each of said curved-shaped elements being formed at its ends with uniform interlocking means for joining said curved-shaped element to other curve-shaped elements, a group of said joined curve-shaped elements which have similar arc curvatures defining a complete circular ring, a plurality of said groups of elements being arranged to provide a plurality of said complete circular rings each placed adjacent to another at predetermined radii of a circle defining a circular shape, said arc curvature indicating placement of individual curve-shaped elements in said circular shape, with each curve-shaped element being removably insertable therein.

2. The game apparatus of claim 1 wherein said curve-shaped elements are sections of a ring.

3. The game apparatus of claim 1 wherein said curve-shaped elements are sections of an ellipse.

4. The game apparatus of claims 1 wherein said interlocking means comprises a tab and recess formed on respective ends of each curve-shaped element.

5. The game apparatus of claim 1 wherein said circular shape is provided within a substantially square frame, and wherein the corner areas of said frame are provided with various geometric shapes which are interlockable one with another to abut against said frame corner area and an outer edge of said circular shape.

6. The game apparatus of claim 1 wherein said curve-shaped elements are provided in different colors on opposite sides.

7. The game apparatus of claim 1 wherein said curve-shaped elements are interlockable such that they are in different planes to form three-dimensional shapes.

8. The game apparatus of claim 1 wherein each of said curve-shaped elements is insertable partially between adjoining elements, providing a stepped construction of elements.

9. The game apparatus of claim 1 wherein said curve-shaped elements are fabricated of soft foam rubber.

10. A method of constructing a curved geometry game apparatus comprising the steps of:

identifying groups of interlockable planar, curve-shaped elements having similar arc curvatures among a plurality of curve-shaped elements, constructing a plurality of rings of curve-shaped elements from the elements in said groups without ordering placement of said elements in said rings; and placing said plurality of rings one within another to form a circular shape.

11. The method of claim 10 wherein said curve-shaped elements are interlockable such that they are in different planes to form three-dimensional shapes.

12. The method of claim 10 wherein each of said curve-shaped elements is insertable partially between adjoining elements, providing a stepped construction of elements.

13. The method of claim 10 wherein said curve-shaped elements are removably insertable from said circular shape and can be oriented reversibly and interlocked to form other shapes.

* * * * *